US011834228B2

(12) United States Patent
Fujishige et al.

(10) Patent No.: US 11,834,228 B2
(45) Date of Patent: Dec. 5, 2023

(54) CAP

(71) Applicant: Daiwa Can Company, Tokyo (JP)

(72) Inventors: Eiji Fujishige, Sagamihara (JP); Junji Matsumura, Sagamihara (JP); Eiji Araki, Sagamihara (JP); Kenji Takagi, Sagamihara (JP); Keisuke Hashimoto, Sagamihara (JP)

(73) Assignee: DAIWA CAN COMPANY, Tokyo (JP)

( * ) Notice: Subject to any disclaimer, the term of this patent is extended or adjusted under 35 U.S.C. 154(b) by 10 days.

(21) Appl. No.: 17/237,214

(22) Filed: Apr. 22, 2021

(65) Prior Publication Data

US 2021/0237943 A1 Aug. 5, 2021

Related U.S. Application Data

(63) Continuation of application No. PCT/JP2019/042544, filed on Oct. 30, 2019.

(30) Foreign Application Priority Data

Oct. 31, 2018 (JP) ..... 2018-205348

(51) Int. Cl.
*B65D 41/34* (2006.01)
*B65D 53/04* (2006.01)

(52) U.S. Cl.
CPC ..... *B65D 41/34* (2013.01); *B65D 53/04* (2013.01)

(58) Field of Classification Search
CPC .. B21D 51/46; B21D 51/2661; B21D 51/443; B65D 41/34; B65D 41/3485; B65D 41/348; B65D 51/1688; B65D 53/04
(Continued)

(56) References Cited

U.S. PATENT DOCUMENTS 2,078,132 A * 4/1937 Fergusson ..... B65D 53/04 215/316
2,130,746 A * 9/1938 Scofield ..... B65D 41/3485 215/350

(Continued)

FOREIGN PATENT DOCUMENTS

CN 1426930 A 7/2003
DE 3416030 A1 10/1985

(Continued)

OTHER PUBLICATIONS

May 17, 2022 Chinese official action (and English translation thereof), in connection with counterpart Chinese Patent Application No. 2019800703898.

(Continued)

*Primary Examiner* — Steven A. Reynolds
*Assistant Examiner* — Prince Pal
(74) *Attorney, Agent, or Firm* — John P. White

(57) ABSTRACT

A cap includes a cap body including a disk-shaped top plate portion and a cylindrical skirt portion provided at a peripheral edge portion of the top plate portion; and a disk-shaped sealing member including a sliding layer and a sealing layer, the sliding layer disposed on the top plate portion side and having a thin portion thinner than at least a center side provided on an outer peripheral edge side, and the sealing layer provided on a main surface opposite to the top plate portion side of the sliding layer and sealing a mouth portion of a can container.

5 Claims, 10 Drawing Sheets

(58) Field of Classification Search
USPC ..... 215/200, 349, 347, 307, 350, 252, 232, 215/261, 270, 260, 343
See application file for complete search history.

(56) References Cited

U.S. PATENT DOCUMENTS 2,994,449 A * 8/1961 Ritzenhoff ..... B65D 41/3485 215/256
3,235,115 A * 2/1966 Duke ..... B65D 41/3409 215/252
3,522,126 A * 7/1970 Ptak ..... B29C 70/80 215/349
3,828,963 A * 8/1974 Moller ..... B65D 53/00 215/337
4,093,094 A * 6/1978 Smalley ..... B65D 51/145 215/276
4,122,964 A * 10/1978 Morris ..... B65D 51/145 215/276
RE31,546 E * 4/1984 Walker ..... B65D 41/348 215/307
4,666,052 A * 5/1987 Ou-Yang ..... B65D 55/066 428/467
4,684,554 A * 8/1987 Ou-Yang ..... C09J 7/35 215/349
5,057,365 A * 10/1991 Finkelstein ..... B67B 3/20 428/347
5,730,306 A * 3/1998 Costa ..... B65D 51/1616 215/261
5,853,096 A * 12/1998 Bartur ..... B65D 51/1688 215/354
6,202,871 B1 * 3/2001 Kelly ..... B65D 41/3423 215/350
6,220,466 B1 * 4/2001 Hayes ..... B65D 51/145 215/276
6,959,830 B1 * 11/2005 Kanou ..... B65D 1/42 215/44
7,147,123 B2 * 12/2006 Yamashita ..... B65D 41/348 220/366.1
7,581,651 B2 * 9/2009 Matukawa ..... B65D 51/1688 215/901
7,780,024 B1 * 8/2010 Marsella ..... B65D 41/045 215/276
7,922,018 B2 * 4/2011 Granger ..... B65D 41/045 215/349
8,181,814 B2 * 5/2012 Awane ..... B65D 7/045 220/619
8,231,019 B2 * 7/2012 Battegazzore ..... B65D 41/0492 215/253
8,689,990 B2 * 4/2014 Hdeyasu ..... B65D 53/04 215/350
9,302,796 B2 * 4/2016 Averett ..... B65D 53/04
10,669,075 B2 * 6/2020 Robles GonzáLez et al. ..... B65D 41/348
10,800,585 B2 * 10/2020 Tsuchiya ..... B29C 43/003
11,130,607 B2 * 9/2021 Hasegawa ..... B65D 1/0246
2006/0054584 A1 * 3/2006 Jackman ..... B65D 51/20 215/347
2006/0071007 A1 * 4/2006 Tsutsumi ..... B65D 41/14 220/254.1
2006/0169665 A1 * 8/2006 Matukawa ..... B65D 51/1688 215/343
2008/0264893 A1 * 10/2008 Battegazzore ..... B65D 41/62 215/252
2010/0065528 A1 * 3/2010 Hanafusa ..... B65D 41/045 215/349
2010/0282707 A1 * 11/2010 Granger ..... B67B 3/12 215/347
2010/0295211 A1 11/2010 Poel-Asendorf et al.
2012/0048825 A1 * 3/2012 Averett ..... B65B 51/227 53/471
2013/0032565 A1 * 2/2013 Fox ..... B65D 51/005 215/247
2013/0056436 A1 * 3/2013 Muto ..... B65D 53/04 215/307
2013/0276413 A1 * 10/2013 Kurmis ..... B65D 41/045 53/484
2016/0207255 A1 * 7/2016 Chang ..... B65D 53/04
2017/0073124 A1 * 3/2017 Brozell ..... B65D 1/023
2017/0137188 A1 * 5/2017 Tsuchiya ..... B29C 43/003
2017/0320637 A1 * 11/2017 Jones ..... B65D 41/349
2019/0084031 A1 * 3/2019 Ross ..... B21D 51/50
2019/0359398 A1 * 11/2019 Shimoji ..... B65D 41/34
2020/0324516 A1 * 10/2020 Roddy ..... B65D 53/04

FOREIGN PATENT DOCUMENTS

JP 2005-022663 A 1/2005
JP 2015-143116 A 8/2015
JP 2017-178421 A 10/2017
JP 2018-131234 A 8/2018
JP 2015-003325 A 1/2021
WO WO 2018-150896 A1 8/2018

OTHER PUBLICATIONS

Jun. 28, 2022 official action in connection with counterpart Japanese Patent Application No. 2018-205348.
Jun. 29, 2022 official communication including search report in connection with counterpart European Patent Application No. 19879503.
International Search Report dated Jan. 21, 2020 in connection with PCT International Patent Application No. PCT/JP2019/042544.
Written Opinion (form PCT/ISA/237) dated Jan. 21, 2020 in connection with PCT International Patent Application No. PCT/JP2019/042544.
International Preliminary Report on Patentability dated May 14, 2021 in International Application No. PCT/JP2019/042544.
Dec. 15, 2021 Notice of Information Statement (and English translation), forwarded by the Japanese Patent Office (JPO), in connection with counterpart Japanese Patent Appl.

* cited by examiner

CAP

CROSS-REFERENCE TO RELATED APPLICATION

This application is a Continuation Application of PCT Application No. PCT JP2019/042544, filed Oct. 30, 2019 and based upon and claiming the benefit of priority from prior Japanese Patent Application No. 2018-205348, filed Oct. 31, 2018, the entire contents of all of which are incorporated herein by reference.

BACKGROUND

1. Field

The present invention relates generally to a cap for closing a can container.

2. Description of the Related Art

Conventionally, a cap for sealing a mouth portion of a can container has a configuration in which a sealing member made of a resin material that comes in close contact with the mouth portion is provided on an inner surface of a cap body. As such a cap, for example, Jpn. Pat. Appln. KOKAI Publication No. 2017-178421 discloses a technique in which a cap body and a sealing member are not bonded to each other in order to reduce opening torque when the cap is opened. Such a sealing member is manufactured by, for example, supplying a molten or softened resin material into the cap body and molding the resin material into a predetermined shape with a mold. The sealing member includes a hard sliding layer having good slidability with respect to a top plate portion on a side facing the top plate portion of the cap body, and a soft sealing layer having good scalability with respect to the mouth portion on a side facing the mouth portion of the can container.

However, in the above-described sealing member, if the thickness of the hard sliding layer is thick, a large load will be required at the time of drawing a corner portion of the cap body when performing capping on the mouth portion of the can container. If the load required for the drawing of the corner portion of the cap body increases, the drawing becomes unstable, which may cause the torque required at the time of opening the cap to increase, or require the container to be strengthened excessively due to the increase in the capping pressure. For this reason, the sliding layer of the sealing member may be considered to be made thinner. However, if the sliding layer is made thinner, the moldability of the sliding layer may deteriorate.

BRIEF SUMMARY OF THE INVENTION

According to an aspect of embodiments, a cap includes a cap body including a disk-shaped top plate portion and a cylindrical skirt portion provided at a peripheral edge portion of the top plate portion; and a disk-shaped sealing member including a sliding layer and a sealing layer, the sliding layer disposed on the top plate portion side and having a thin portion thinner than at least a center side provided on an outer peripheral edge side, and the sealing layer provided on a main surface opposite to the top plate portion side of the sliding layer and sealing a mouth portion of a can container.

DETAILED DESCRIPTION

Hereinafter, a cap 1 according to a first embodiment of the present invention will be described with reference to FIG. 1 to FIG. 6.

Figure 1:
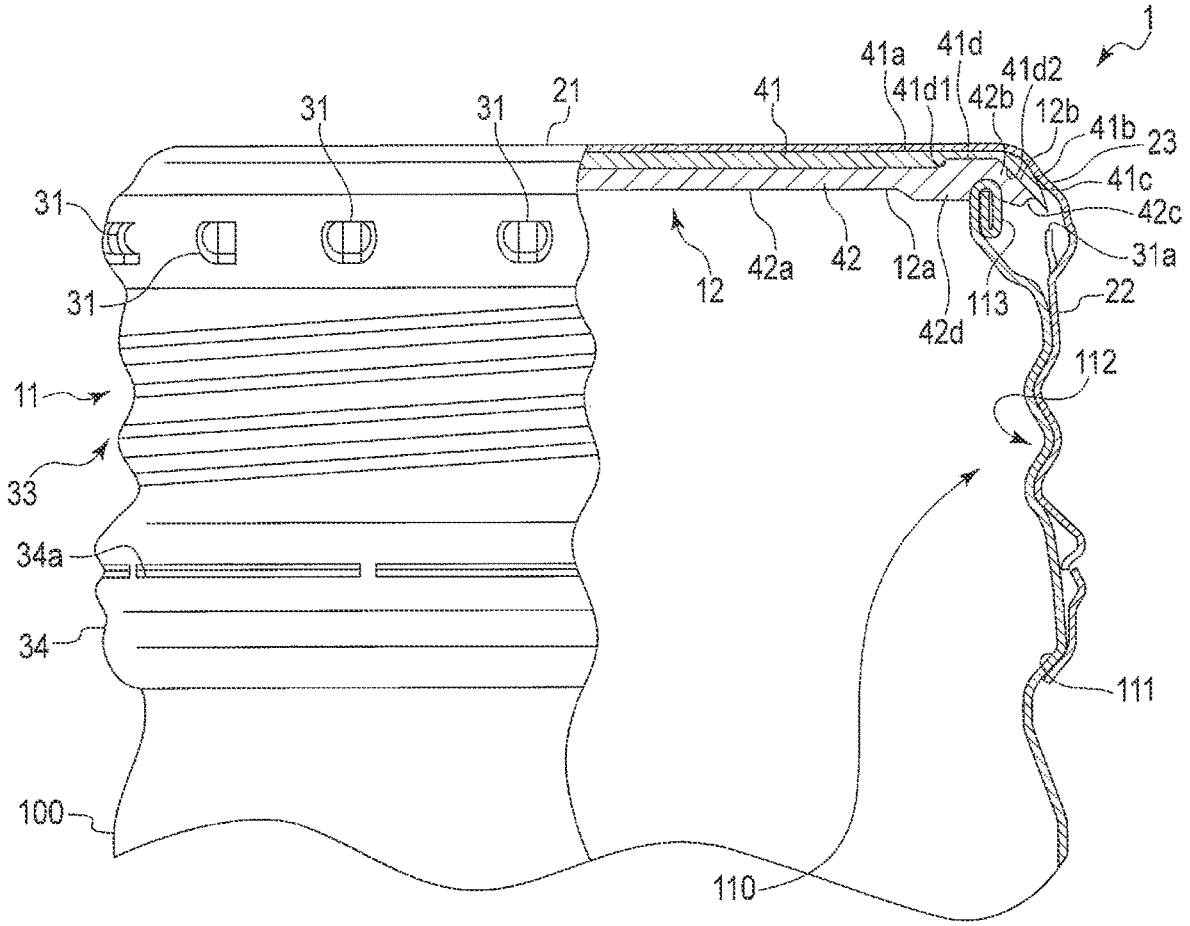
FIG. 1 is a side view showing a configuration of a cap and a mouth portion of a can container according to a first embodiment of the present invention partially in section.
Figure 2:
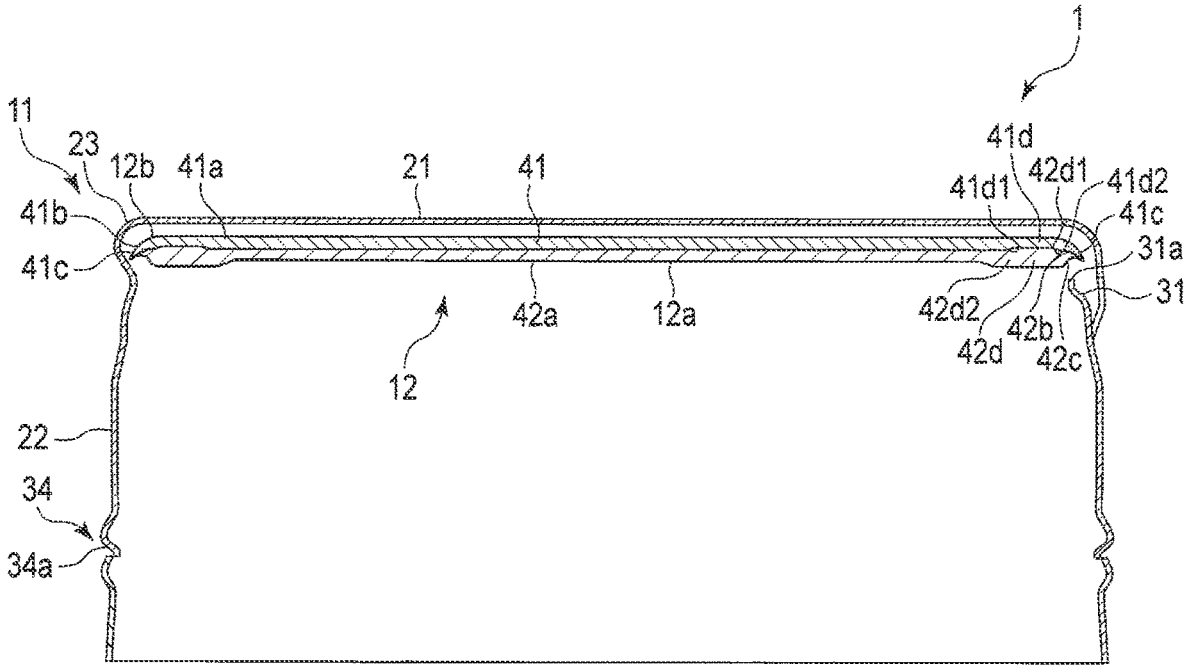
FIG. 2 is a cross-sectional view showing the configuration of the cap with a part thereof omitted.
Figure 3:
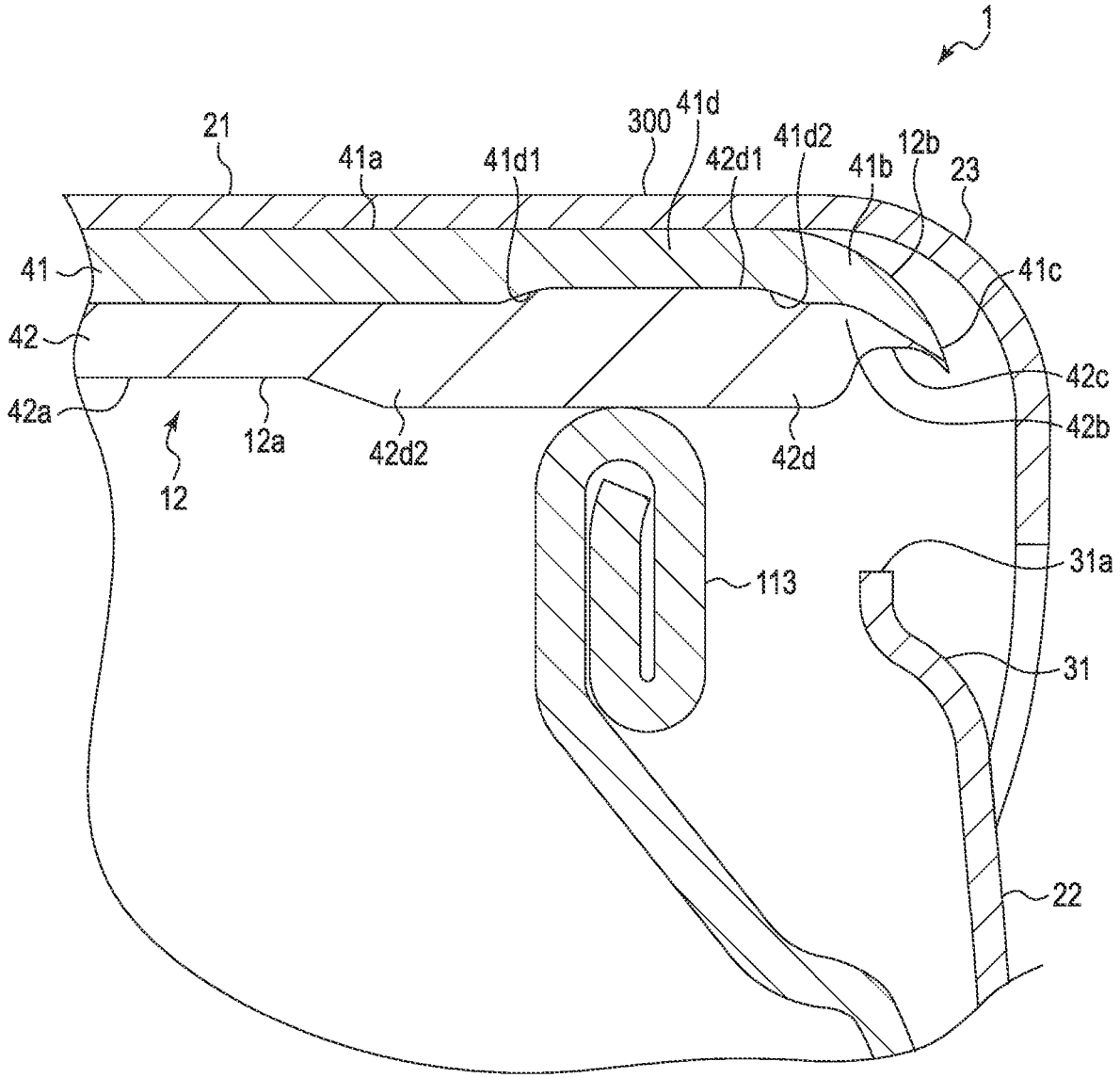
FIG. 3 is a cross-sectional view showing a configuration of a main part of the cap.
Figure 4:
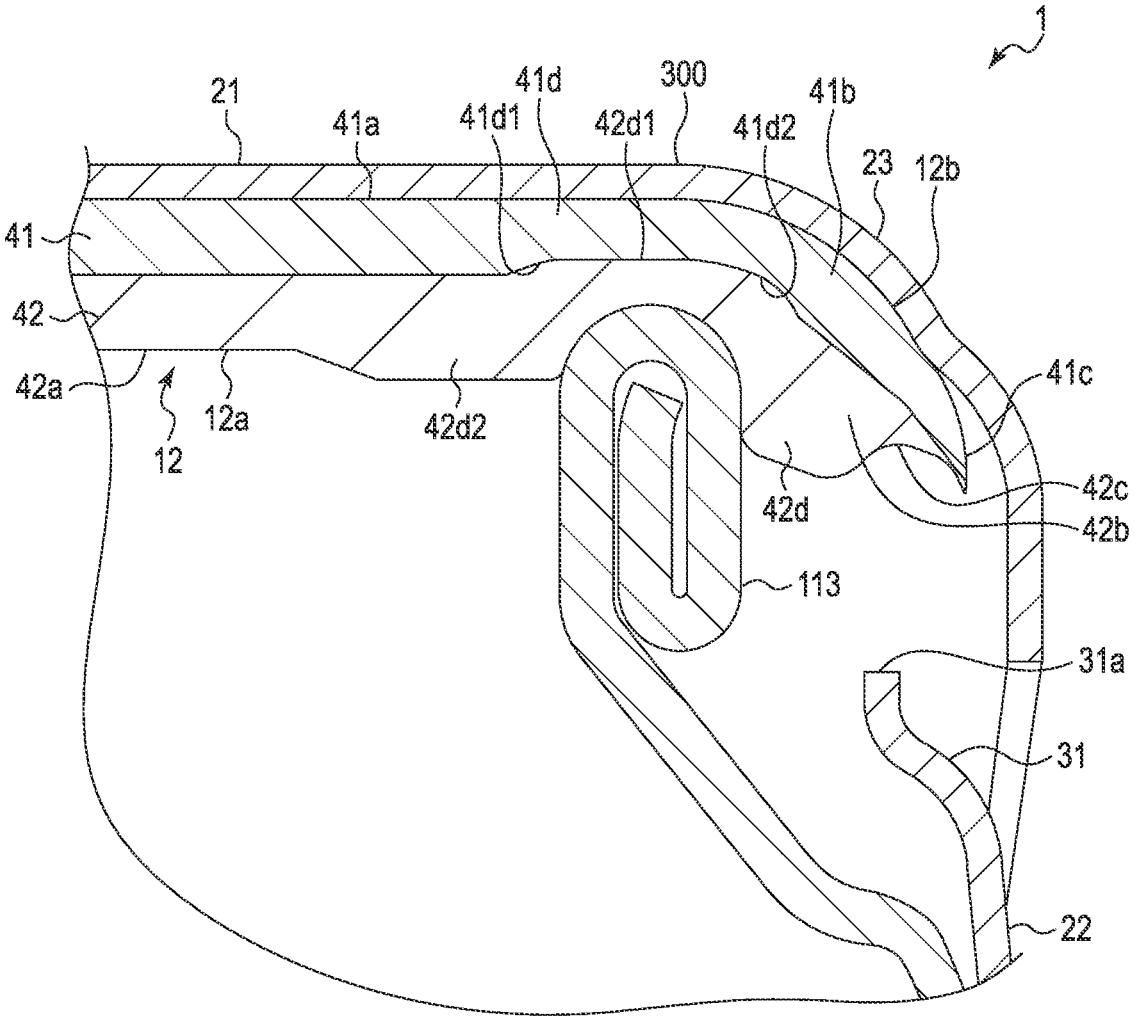
FIG. 4 is a cross-sectional view showing a configuration of a main part of the p.
Figure 5:
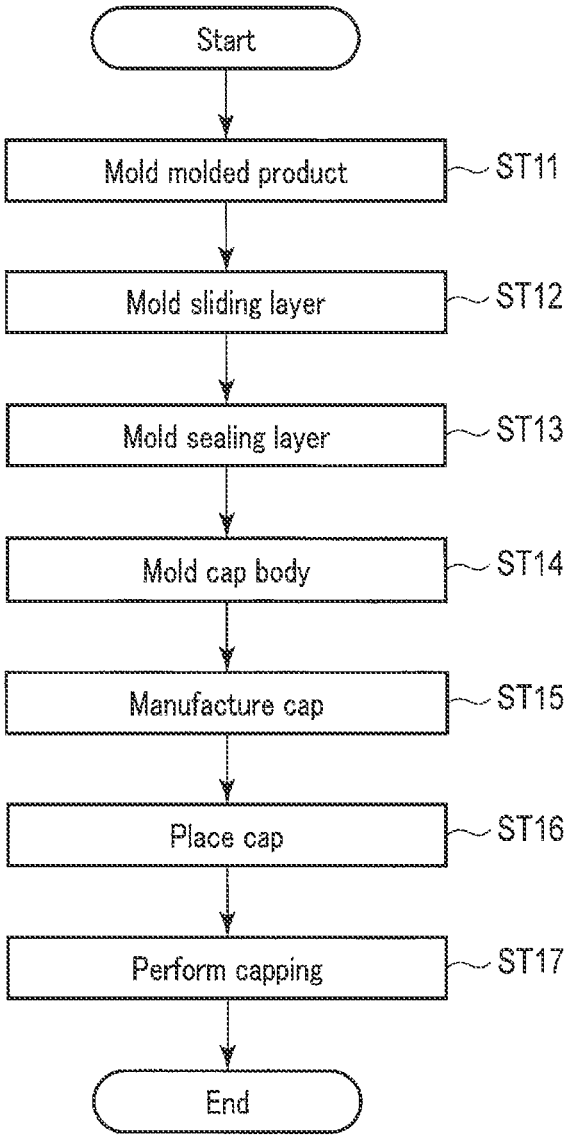
FIG. 5 is a flow chart showing a method of manufacturing the cap.
Figure 6:
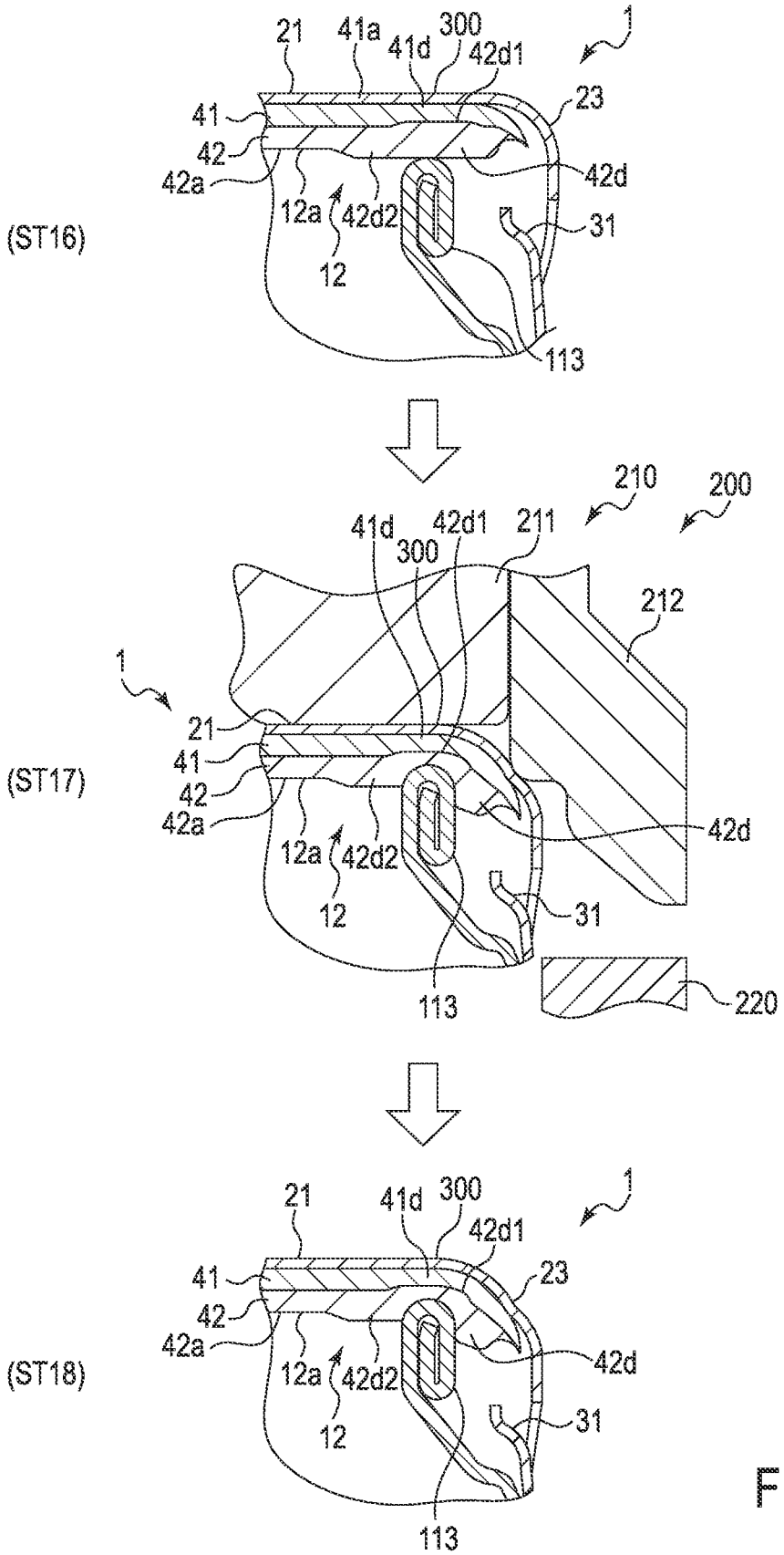
FIG. 6 is a flow chart schematically showing a part of the manufacturing method of the cap.

FIG. 1 is a side view showing the configuration of the cap 1 and a mouth portion 110 of a can container 100 according to the first embodiment of the present invention, partly in section. FIG. 2 is a cross-sectional view showing the configuration of the cap 1 with a part thereof omitted. FIG. 3 is a cross-sectional view showing a configuration of a main part before the cap 1 is wound and compacted on the can container 100. FIG. 4 is a cross-sectional view showing a configuration of a main part after the cap 1 is wound and compacted on the can container 100. FIG. 5 is a flow chart showing a method of manufacturing the cap 1. FIG. 6 is a flow chart schematically showing a part of the manufacturing method of the cap 1.

As shown in FIG. 1, the cap 1 is attached to the mouth portion 110 of the can container 100, and is wound and compacted by drawing in a state of covering the mouth portion 110 of the can container 100, thereby sealing the can container 100. By sealing the can container 100, the cap 1 constitutes a bottle can in which liquid such as beverage is sealed and filled together with the can container 100.

Here, the can container 100 is a so-called bottle-shaped container that contains a beverage or the like. For example, the can container 100 is made of a metal material such as an aluminum alloy or a surface-treated steel plate having resin films laminated on both surfaces thereof. The can container 100 is formed in a cylindrical shape having a different outer diameter with one end reduced in diameter. The can container 100 has a mouth portion 110 at one end for discharging the contained beverage. The mouth portion 110 has a jaw portion 111, a male screw portion 112, and a curl portion 113 on the outer peripheral surface thereof from the bottom surface side of the can container 100 toward the end portion.

The jaw portion 111 is configured to protrude annularly. The curl portion 113 is formed to have a smaller diameter than the male screw portion 112. The curl portion 113 is configured to be smaller than the inner diameter of the cap 1. The curl portion 113 is formed by folding the end portion of the mouth portion 110 once or more. The curl portion 113 forms an opening through which the beverage contained in the can container 100 is discharged.

As shown in FIG. 1 to FIG. 4, the cap 1 includes a cap body 11 and a sealing member 12 provided separately in the cap body 11.

The cap body 11 is made of a material obtained by forming a resin coating layer on a metal material such as an aluminum alloy. The cap body 11 is formed by drawing such a thin plate-shaped material into a cup shape and then performing each molding such as knurling and roll-on molding.

The cap body 11 includes a disk-shaped top plate portion 21 and a cylindrical skirt portion 22 provided integrally with a peripheral edge portion of the top plate portion 21. In the cap body 11, the top plate portion 21 and the skirt portion 22 are integrally and continuously formed by an annular and curved corner portion 23.

The top plate portion 21 is formed in a disk shape and has a flat main surface. One end of the skirt portion 22 is continuous with the top plate portion 21 via the corner portion 23, and the other end is open. The skirt portion 22 includes a plurality of knurl portions 31 including a vent slit 31*a*, a female screw portion 33 and a tamper evidence band portion 34 from an end portion on the top plate portion 21 side to an opened end portion.

As shown in FIG. 1 and FIG. 2, the plurality of knurl portions 31, the female screw portion 33, and the tamper evidence band portion 34 are formed by performing processing, such as knurling or roll-on molding, on a cup-shaped molded product including the top plate portion 21, the cylindrical skirt portion 22 on which the plurality of knurl portions 31, the female screw portion 33, and the tamper evidence band portion 34 are not formed, and the corner portion 23.

The knurl portion 31 includes the vent slit 31*a* and protrudes from the inner peripheral surface of the skirt portion 22. In other words, the knurl portion 31 forms a partially notched protrusion on the inner peripheral surface of the skirt portion 22 by recessing a portion of the skirt portion 22 inward in the radial direction of the skirt portion 22.

The plurality of knurl portions 31 are provided in the circumferential direction of the skirt portion 22. The vent slit 31*a* is a cut for discharging gas or the like in the can container 100 at the time of opening. The vent slit 31*a* is formed by cutting an end portion of the knurl portion 31 on the top plate portion 21 side.

The diameters of the tangent circle's connecting the end portions of the plurality of knurl portions 31 on the vent slit 31*a* side, in other words, the end portions of the plurality of knurl portions 31 on the top plate portion 21 side are set to be smaller than the outer diameter of the sealing member 12. Therefore, the plurality of knurl portions 31 constitute locking portions that restrict movement of the sealing member 12 disposed on the top plate portion 21 in a direction away from the top plate portion 21.

The female screw portion 33 is configured to be screwed with the male screw portion 112 of the can container 100. The female screw portion 33 is molded together with the can container 100. That is, the female screw portion 33 is not molded in the cap 1 before attachment to the can container 100; however, it is molded when being integrally combined with the can container 100.

The tamper evidence band portion 34 engages with the jaw portion 111 of the can container 100 in a direction in which the cap 1 moves away from the can container 100 and in an axial direction of the cap 1. Furthermore, the tamper evidence band portion 34 has a breaking portion 34*a* which is broken when the cap 1 is opened and is detached from the skirt portion 22. That is, the tamper evidence band portion 34 is configured by forming a slit on the end portion side of the skirt portion 22 while leaving a breaking portion 34*a*, and is shaped into the shape of the jaw portion 111 of the can container 100 when integrally combined with the can container 100, thereby engaging with the jaw portion 111, in a manner similar to the female screw portion 33. The corner portion 23 is, for example, an annular corner portion whose cross-sectional shape is curved at one center of curvature before the cap body 11 is wound around and compacted on the mouth portion 110 of the can container 100. The corner portion 23 is formed, for example, in an annular corner portion whose cross-sectional shape is curved at at least two centers of curvature by a part of the corner portion 23 being pressed in the axial direction in an annular shape along the circumferential direction at the time of drawing when the cap body 11 is wound and compacted on the mouth portion 110 of the can container 100.

The sealing member 12 is formed separately from the cap body 11. That is, the sealing member 12 is disposed to face the top plate portion 21 and the skirt portion 22, and is not bonded to the cap 1. Specifically, the sealing member 12 is formed in a disk shape and has an outer diameter set to be larger than the diameter of the inscribed circle of the knurl portion 31 provided in the skirt portion 22 of the cap body 11.

The sealing member 12 is provided integrally with the cap body 11 by being engaged in the axial direction of the cap body 11 with the end portion provided with the vent slit 31*a* of the knurl portion 31 protruding in the radial direction from the inner peripheral surface of the skirt portion 22.

The sealing member 12 includes a disk-shaped sliding layer 41 and a disk-shaped sealing layer 42 integrally laminated on the sliding layer 41. The sealing member 12 is configured by integrally molding the sliding layer 41 and the sealing layer 42 with different resin materials. The sealing member 12 includes a flat plate portion 12*a* that is uniformly thick, and a curved surface portion 12*b* in which an outer surface of an outer peripheral edge on the top plate portion 21 side is formed of a curved surface.

In other words, the sealing member 12 is formed in a disk shape, and the ridge portion on the top plate portion 21 side is configured by a curved surface having a predetermined curvature. Furthermore, the sealing member 12 is configured such that the curved surface portion 12*b* configuring the outer peripheral edge side is thinner than the flat plate portion 12*a*. In addition, the sealing member 12 is configured such that the curved surface portion 12*b* becomes gradually thinner from the center side toward the outer peripheral edge, and the distal end of the curved surface portion 12*b*, that is, the outer peripheral edge, is configured to be thinnest among other portions.

The flat plate portion 12*a* configures a sealing portion in which a part of the curved surface portion 12*b* side comes into contact with the mouth portion 110 of the can container 100. The flat plate portion 12*a* is configured such that the sealing portion that comes in contact with the mouth portion 110 of the can container 100 is formed thicker than the other parts.

The sliding layer 41 is made of a resin material whose hardness is relatively higher (harder) than that of the sealing layer 42. Furthermore, the sliding layer 41 is made of a resin material that does not have adhesiveness and tackiness to the resin coating layer of the cap body 11. That is, the sliding layer 41 is not bonded to the top plate portion 21 and slides on the top plate portion 21 in a state of being in contact with the top plate portion 21.

Examples of the resin material used for the sliding layer 41 include olefin-based resins such as polypropylene resins and polyethylene resins, polyester-based resins such as polyethylene terephthalate, styrene-based resins, and acrylic resins. In the present embodiment, the sliding layer 41 is made of, for example, polypropylene resin. A pigment, a lubricant, a softener, and the like can be appropriately added to the resin material used for the sliding layer 41.

As shown in FIG. 1 to FIG. 4, the sliding layer 41 is provided separately from the cap body 11 in a manner facing the top plate portion 21 of the cap body 11. The sliding layer 41 is configured to be slidable with the top plate portion 21 of the cap body 11 by the resin material that is used. The sliding layer 41 is formed in a disk shape. The outer diameter of the sliding layer 41 is smaller than the inner diameter of the skirt portion 22, larger than the inscribed circle of the plurality of knurl portions 31, and larger than the outer diameter of the curl portion 113 the mouth portion 110.

The sliding layer 41 includes a first flat plate portion 41*a*, a first curved surface portion 41*b* in which an outer surface of an outer peripheral edge on the top plate portion 21 side is formed of a curved surface, a protruding portion 41*c* provided on the sealing layer 42 side of the first curved surface portion 41*b*, and a thin portion 41*d* provided on the first flat plate portion 41*a*. The first flat plate portion 41*a* is configured in a manner such that the portion from the center of the sliding layer 41 to the outer peripheral side of a portion facing the curl portion 113 of the mouth portion 110 has a uniform thickness except for the thin portion 41*d*.

The first curved surface portion 41*b* is curved on the top plate portion 21 side, so that the thickness of a portion from the outer peripheral side of a portion facing the curl portion 113 of the mouth portion 110 to the outer peripheral edge gradually decreases toward the outer peripheral edge. Furthermore, for example, in the first curved surface portion 41*b*, a portion adjacent to the first flat plate portion 41*a* has the same thickness as the first flat plate portion 41*a* and is set to be thicker than the thin portion 41*d*.

The protruding portion 41*c* is provided on the opening side of the skirt portion 22 on the outer peripheral edge of the first curved Surface portion 41*b*. The protruding portion 41*c* is configured in an annular protruding shape that is inclined with respect to the axial direction of the sliding layer 41 and the surface direction of the top plate portion 21 and is curved or inclined toward the opening end portion side of the skirt portion 22. The thickness of the protruding portion 41*c* gradually decreases from the first curved surface portion 41*b* toward the distal end.

The thin portion 41*d* is provided on the main surface of the first flat plate portion 41*a* on the opening side of the skirt portion 22. The thin portion 41*d* is an annular recess in which the main surface on the opening side of the skirt portion 22 is configured to be parallel to the main surface of the first flat plate portion 41*a* on the opening side of the skirt portion 22. The thin portion 41*d* is continuous with the first flat plate portion 41*a* and the first curved surface portion 41*b* at inclined surfaces 41*d*1 and 41*d*2 inclined with respect to the main surface of the thin portion 41*d*.

That is, since the thin portion 41*d* is continuous with portions adjacent to the thin portion 41*d* on the radially inner and outer sides at the inclined surfaces 41*d*1 and 41*d*2, the portions adjacent to the thin portion 41*d* on the radially inner and outer sides are thicker than the thin portion 41*d*. In the present embodiment, the portions adjacent to the radially inner and outer sides of the thin portion 41*d* are the portion of the first flat plate portion 41*a* excluding the thin portion 41*d* and the first curved surface portion 41*b*.

To be more specific, the main surface of the thin portion 41*d* and the main surface of the first flat plate portion 41*a* are made continuous by an annular inclined surface 41*d*1. Here, the inclination angle of the inclined surface 41*d*1 can be appropriately set as long as the inclined surface 41*d*1 can guide the resin material of the sealing layer 42 to the thin portion 41*d*.

The main surface of the thin portion 41*d* and the main surface of the first curved surface portion 41*b* are made continuous by an annular inclined surface 41*d*2. Here, the inclination angle of the inclined surface 41*d*2 can be appropriately set as long as the inclined surface 41*d*2 can guide the resin material of the sealing layer 42 to the thin portion 41*d*.

The thin portion 41*d* is provided on the main surface side of the first flat plate portion 41*a* opposite to the top plate portion 21, that is, on the main surface side on which the sealing layer 42 is laminated. In a state where the sealing member 12 is disposed in the cap body 11, the thin portion 41*d* is provided at a position facing a base point 300 of deformation of the top plate portion 21 when the cap 1 is attached to the can container 100 and drawing of the corner portion 23 of the cap body 11 is performed. Furthermore, the thin portion 41*d* is provided at a position adjacent to a portion of the sealing layer 42 facing the mouth portion 110 in the axial direction when the cap 1 is attached to the can container 100.

The thin portion 41*d* has a width in the radial direction formed in such a width to enable the thin portion to be in a position that faces the base point 300 of deformation of the top plate portion 21 at the time of performing drawing and in a position that faces the mouth portion 110 in the axial direction when the sealing member 12 is disposed in the cap body 11 and the cap 1 is placed on the mouth portion 110 of the can container 100. Here, the width of the thin portion 41*d* in the radial direction is appropriately set in consideration of the difference between the inner diameter of the cap body 11 and the outer diameter of the sealing member 12, the shrinkage rate of the resin material configuring the sliding layer 41 and the sealing layer 42 of the sealing member 12, the amount of deformation of the sliding layer 41 due to external forces, dimensional accuracy, and the like.

The sealing layer 42 is made of a resin material whose hardness is relatively lower (softer) than that of the sliding layer 41. Examples of the resin material used for the sealing layer 42 include an olefin-based resin, polyester-based resin, a styrene-based resin, and an acrylic-based resin, and more preferably include a blended material of a styrene-based elastomer and a polypropylene resin, a blended material of low-density polyethylene and a styrene-based elastomer, and a polyester-based elastomer. In the present embodiment, the sealing layer 42 is made of, for example, a mixed material of a styrene-based elastomer and a polypropylene resin. A pigment, a lubricant, a softener, and the like can be appropriately added to the resin material used for the sealing layer 42.

As shown in FIG. 1 to FIG. 4, the sealing layer 42 is integrally provided on the main surface of the sliding layer 41 on the side facing the mouth portion 110. The sealing layer 42 is formed in a disk shape. The outer diameter of the sealing layer 42 is configured to be larger than the outer diameter of the curl portion 113 of the mouth portion 110, and is configured to be substantially the same as the outer diameter of the sliding layer 41.

As shown in FIG. 3, the sealing layer 42 includes a second flat plate portion 42*a* whose portion facing the mouth portion 110 is thicker than other portions, a second curved surface portion 42*b* whose outer surface of the outer peripheral edge on the top plate portion 21 side is a curved surface, an annular recess 42*c* provided on the main surface of the second curved surface portion 42*b* on the side opposite to the sliding layer 41 side, and a thick portion 42*d* provided on the second flat plate portion 42*a*. The second flat plate portion 42*a* has a flat main surface facing the curl portion 113. For example, the second flat plate portion 42*a* has the same diameter as the first flat plate portion 41*a* of the sliding layer 41. The second flat plate portion 42*a* configures the flat plate portion 12*a* of the sealing member 12 together with the first flat plate portion 41*a*.

The second curved surface portion 42*b* has, for example, a main surface flush with a main surface of the second flat plate portion 42*a* facing the curl portion 113. The second curved surface portion 42*b* is configured in a manner such that the thickness of a portion from the outer peripheral side of a portion facing the curl portion 113 of the mouth portion 110 to the outer peripheral edge is made gradually thinner toward the outer peripheral edge. The second curved surface portion 42*b* is stacked on the first curved surface portion 41*b* and the protruding portion 41*c*. The second curved surface portion 42*b* configures the curved surface portion 12*b* of the sealing member 12 together with the first curved surface portion 41*b* and the protruding portion 41*c*.

The recess 42*c* is, for example, an annular recess having a semi-circular cross section. When the sealing member 12 is disposed in the cap body 11, the recess 42*c* comes into contact with, for example, an end portion of the knurl portion 31 on the vent slit 31*a* side.

The thick portion 42*d* corresponds to annular protrusions 42*d*1 and 42*d*2 protruding from both main surfaces of the second flat plate portion 42*a*. A first protrusion 42*d*1 provided in the thick portion 42*d* protrudes from the main surface on the sliding layer 41 side of the second flat plate portion 42*a* of the thick portion 42*d* and is annular. An annular second protrusion 42*d*2 protruding from the main surface of the second flat plate portion 42*a* of the thick portion 42*d* on the side opposite to the sliding layer 41 side covers the first protrusion 42*d*1 in the axial direction and has a width wider than that of the first protrusion 42*d*1 in the radial direction.

The thick portion 42*d* and the thin portion 41*d* configure a sealing portion that comes into contact with the mouth portion 110 of the can container 100. The thickness of the thick portion 42*d* is set so that the difference between the thickness of the thick portion 42*d* and the thickness of the second flat plate portion 42*a* becomes larger than the depth of the thin portion 41*d* from the first flat plate portion 41*a*. That is, by setting the thickness of the first protrusion 42*d*1 to be the same as the depth of the thin portion 41*d*, and by forming the thick portion 42*d* further including the second protrusion 42*d*2, the sealing portion of the flat plate portion 12*a* of the sealing member 12 that comes into contact with the mouth portion 110 is configured to be thicker than the other portions of the flat plate portion 12*a*.

Specifically, the width of the first protrusion 42*d*1 in the radial direction is the same as the width of the thin portion 41*d*. That is, the first protrusion 42*d*1 has a width in the radial direction such that the first protrusion faces the base point 300 of deformation of the top plate portion 21 at the time of performing drawing and faces the mouth portion 110 in the axial direction when the sealing member 12 is disposed in the cap body 11 and the cap 1 is placed on the mouth portion 110 of the can container 100. Specifically, the second protrusion 42*d*2 has a width in the radial direction such that the second protrusion faces the mouth portion 110 in the axial direction when the sealing member 12 is disposed in the cap body 11 and the cap 1 is placed on the mouth portion 110 of the can container 100.

Here, the width of the first protrusion 42*d*1 in the radial direction and the width of the second protrusion 42*d*2 in the radial direction are appropriately set in consideration of the difference between the inner diameter of the cap body 11 and the outer diameter of the sealing member 12, the shrinkage rate of the resin material configuring the sliding layer 41 and the sealing layer 42 of the sealing member 12, the amount of deformation of the sliding layer 41 due to external forces, dimensional accuracy, and the like.

When the cap 1 is disposed in a state where the top plate portion 21 faces upward and the sealing member 12 falls below the top plate portion 21, the sealing member 12 comes into contact with an end portion of the knurl portion 31 on the vent slit 31*a* side, whereby the sealing member 12 is locked by the knurl portion 31 and is restricted from moving downward in the direction of gravity. When the cap 1 is placed on the mouth portion 110 of the can container 100, the thick portion 42*d* of the sealing member 12 comes into contact with the mouth portion 110, and the thin portion 41*d* of the sealing member 12 is disposed so as to face the base point 300 of deformation of the top plate portion 21 during drawing of the corner portion 23.

A method of manufacturing the cap 1 configured in the above manner will be described below with reference to FIG. 5 and FIG. 6. Since the female screw portion 33 provided in the cap body 11 is molded when the can container 100 is capped with the cap 1, a method for manufacturing the cap including a method for manufacturing a bottle can in which the cap 1 is attached to the can container 100 and the can container 100 is sealed will be described.

First, for example, a metallic plate material is processed, and a cup-shaped molded product is molded from the metallic plate material (step ST11). This molded product is the cap body 11 in which the plurality of knurl portions 31, the female screw portion 33, and the tamper evidence band portion 34 are not molded. That is, the molded product is configured by the top plate portion 21, the cylindrical skirt portion 22 in which the plurality of knurl portions 31, the female screw portion 33, and the tamper evidence band portion 34 are not molded, and the corner portion 23.

Next, the sliding layer 41 is molded (step ST12). As a specific example, for example, the cap body 11 is disposed on a lower mold in a posture in which the top plate portion 21 is positioned on the lower side in the direction of gravity. A molten or softened resin material for the sliding layer 41 is then supplied onto the top plate portion 21, and the supplied resin material is compression-molded by an upper mold to mold the sliding layer 41.

Next, the sealing layer 42 is molded (step ST13). As a specific example, for example, a molten or softened resin material for the sealing layer 42 is supplied onto the sliding layer 41, and the supplied resin material is compression-molded by the upper mold to mold the sealing layer 42 on the sliding layer 41. By these steps, the sealing member 12 in which the sliding layer 41 and the sealing layer 42 are laminated is manufactured in the molded product.

Next, the molded product is processed to mold the cap body 11 (step ST14). As a specific example, the knurl portion 31, the vent slit 31*a*, the tamper evidence band portion 34, and the like are molded in the skirt portion 22 of the molded product. By this step, the cap body 11 is manufactured. When the cap body 11 is molded, the sealing member 12 is removed from the molded product.

The sealing member 12 is then inserted into the manufactured cap body 11 to manufacture the cap 1 (step ST15). Through these steps, the cap 1 is manufactured.

Next, a beverage or the like is filled in a separately manufactured can container 100. At this time, the can container 100 is in an upright posture in which the mouth portion 110 is positioned at an upper portion. Next, the can container 100 is covered with the cap 1 (step ST16). Specifically, the cap 1 is placed on the mouth portion 110 of the can container 100 with the top plate 21 facing upward.

When the cap 1 is in a posture in which the top plate portion 21 is placed upward, and the sealing member 12 descends by a certain distance in a direction away from the op plate portion 21, the sealing member 12 is supported by the end portion of the knurl portion 31, and the descending movement of the sealing member 12 is restricted. When the cap 1 is placed on the mouth portion 110 in this state, the thick portion 42*d* of the sealing layer 42 of the sealing member 12 faces the mouth portion 110, and, as shown by ST16 in FIG. 6, the mouth portion 110 and the thick portion 42*d* come into contact with each other.

Next, the can container 100 is capped with the cap 1 by using a mold 200 of the molding apparatus (step ST17). As a specific example of capping, in a state where the cap 1 covers the mouth portion 110, the corner portion 23 is drawn, then the skirt portion 22 is roll-on molded.

Here, the mold 200 includes a first mold 210 for drawing the corner portion 23, a second mold 220 for roll-on molding the skirt portion 22, and a drive mechanism for driving the first mold 210 and the second mold 220. The first mold 210 includes a fixed mold 211 that comes into contact with the top plate portion 21 and a movable mold 212 that applies a load in the axial direction to the corner portion 23.

As shown in ST17 of FIG. 6, a specific example of capping using the mold 200 will be described. First, the top plate portion 21 is pressed by the fixed mold 211, and the mouth portion 110 is made to come into close contact with the sealing member 12. At this time, the sealing member 12 is in a state where the thick portion 42*d* is compressed on the sealing layer 42 by the mouth portion 110. In a state where the top plate portion 21 and the sealing member 12 are disposed between the mouth portion 110 and the fixed mold 211, the movable mold 212 applies a downward load in the axial direction to the corner portion 23, thereby shaping the corner portion 23 and drawing the corner portion 23 into a predetermined shape. In addition, by roll-on molding the skirt portion 22 using the second mold 220, the female screw portion 33 having the shape of the male screw portion 112 of the can container 100 is molded on the skirt portion 22.

After the molding, by retracting the mold 200 from the cap 1, the cap 1 is wound and compacted on the mouth portion 110 of the can container 100, thereby completing the capping of the cap 1 (step ST16 in FIG. 6), and a bottle can filled with a beverage is manufactured.

According to the cap 1 configured in the above manner, the thin portion 41*d* is provided in the sliding layer 41, and at a position facing the base point 300 of the deformation of the top plate portion 21 when the corner portion 23 is drawn. With this configuration, in the cap 1, the deformation of the sliding layer 41 caused by the drawing of the corner portion 23 during the drawing at the time of capping is facilitated, and the drawing moldability of the cap body 11 at the time of capping can be improved.

This effect will be specifically described below. The sliding layer 41 is harder than the sealing layer 42. When the corner portion 23 is drawn, the top plate portion 21 is sandwiched between the first mold 210 and the mouth portion 110 together with the sealing member 12, For this reason, when the drawing of the corner portion 23 is performed, the top plate portion 21 is plastically deformed downward from a portion facing the mouth portion 110 as a base point in the axial direction as illustrated in ST16 and ST17 of FIG. 6. At this time, since the sealing member 12 is disposed on the inner surface of the top plate portion 21 on the mouth portion 110 side, the load applied to the corner portion 23 at the time of drawing requires a load for elastically deforming the sliding layer 41 in addition to the load for plastically deforming the top plate portion 21.

However, in the present embodiment, in the sealing member 12, the thin portion 41*d* for reducing the bending strength of the sliding layer 41 is provided at a portion facing the base point 300 of the deformation of the top plate portion 21 at the time of drawing the corner portion 23. Therefore, the load required to deform the sliding layer 41 at the time of drawing the corner portion 23 can be reduced. As a result, the cap 1 can reduce the load at the time of drawing, and can be stably drawn. As described above, according to the cap 1 of the present embodiment, the cap body 11 can be suitably drawn.

In addition, it is possible to prevent variations in the shape of the corner portion 23 when the can container 100 is capped with the cap 1. Therefore, it is possible to prevent the torque required for the cap 1 from increasing at the time of opening the cap, and it is not necessary to excessively secure the strength of the can container due to the possibility that the capping pressure may increase.

In the sealing member 12, the sliding layer 41 is configured such that, the outer peripheral side of the thin portion 41*d*, which in the present embodiment, the end portion on the first flat plate portion 41*a* side of the first curved surface portion 41*b* is thicker than the portion of the thin portion 41*d*. With this configuration, the sealing member 12 can increase the rigidity of the outer peripheral side of the sliding layer 41 even in a configuration in which the thin portion 41*d* is provided in the sliding layer 41. Therefore, when the sealing member 12 comes into contact with the end portion of the knurl portion 31 on the vent slit 31*a* side, deformation of the outer peripheral side of the sealing member 12 can be suppressed, and thus the sealing member 12 can be reliably locked to the end portion of the knurl portion 31 on the vent slit 31*a* side. As a result, the cap 1 can prevent the sealing member 12 from falling off from the cap body 11.

In addition, the sealing member 12 is configured such that the protrusions 42*d*1 and 42*d*2 are provided respectively in the portions of both main surfaces of the second flat plate portion 42*a* of the sealing layer 42 that come into contact with the mouth portion 110, in order to make the sealing portion thicker than the other portions. With this configuration, it is possible to increase the amount of deformation of the sealing layer 42 when coming into close contact with the mouth portion 110, thereby enabling the mouth portion 110 to be reliably sealed.

In addition, by providing the thin portion 41*d* and the thick portion 42*d* in the sealing portion of the sealing member 12 with which the mouth portion 110 comes into contact, the ratio of the sealing layer 42 in the sealing portion can be increased. Therefore, when the mouth portion 110 is in close contact with the sealing layer 42, the portion of the mouth portion 110 that is inserted into the sealing layer 42 can be made longer in the axial direction, and thus the seal opening degree of the cap 1 with respect to the mouth portion 110 can be made longer than in a case where the second protrusion 42*d*2 is not provided. That is, iv when the seal opening degree is increased, it is possible to extend the distance in which the cap 1 rotates until the internal pressure in the can container 100 escapes from the vent slit 31*a*. Therefore, for example, even if the cap 1 is slightly rotated by accident or deliberately when a bottle can filled with a beverage is displayed, it is possible to prevent the seal from being broken.

Furthermore, the sealing member 12 is configured in a manner that the thin portion 41*d* and the thick portion 42*d* are extended in the radial direction. With this configuration, when the cap 1 is placed on the can container 100, the thin portion 41*d* can be made adjacent to the base point 300 of the deformation of the top plate portion 21 at the time of drawing the corner portion 23 in the axial direction, and the thick portion 42*d* can be made adjacent to the mouth portion 110. As a result, the cap 1 can reliably achieve the above-described effects even if there are variations in dimensional accuracy in manufacturing the cap body 11 and the sealing member 12, differences in the shrinkage rate in manufacturing the sealing member 12 due to season or the like, radial positional deviation of the sealing member 12 with respect to the cap body 11, and the like.

As described above, according to the cap 1 of the embodiment of the present invention, the sliding layer 41 has good moldability, and the cap body 11 can be suitably drawn.

Figure 7:
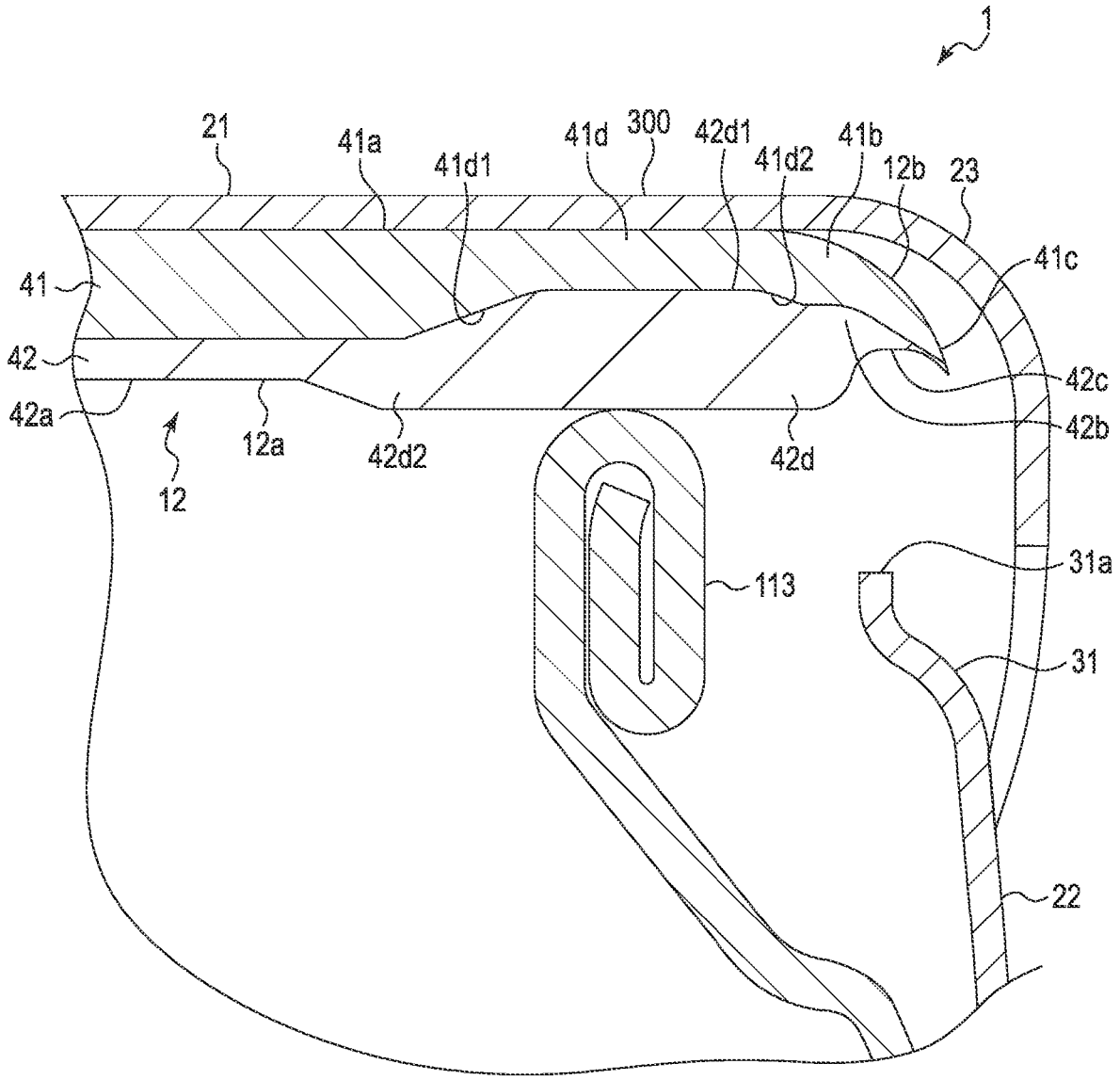
FIG. 7 is a cross-sectional view showing a configuration of a main part of a cap according to a first modification of the present invention.
Figure 8:
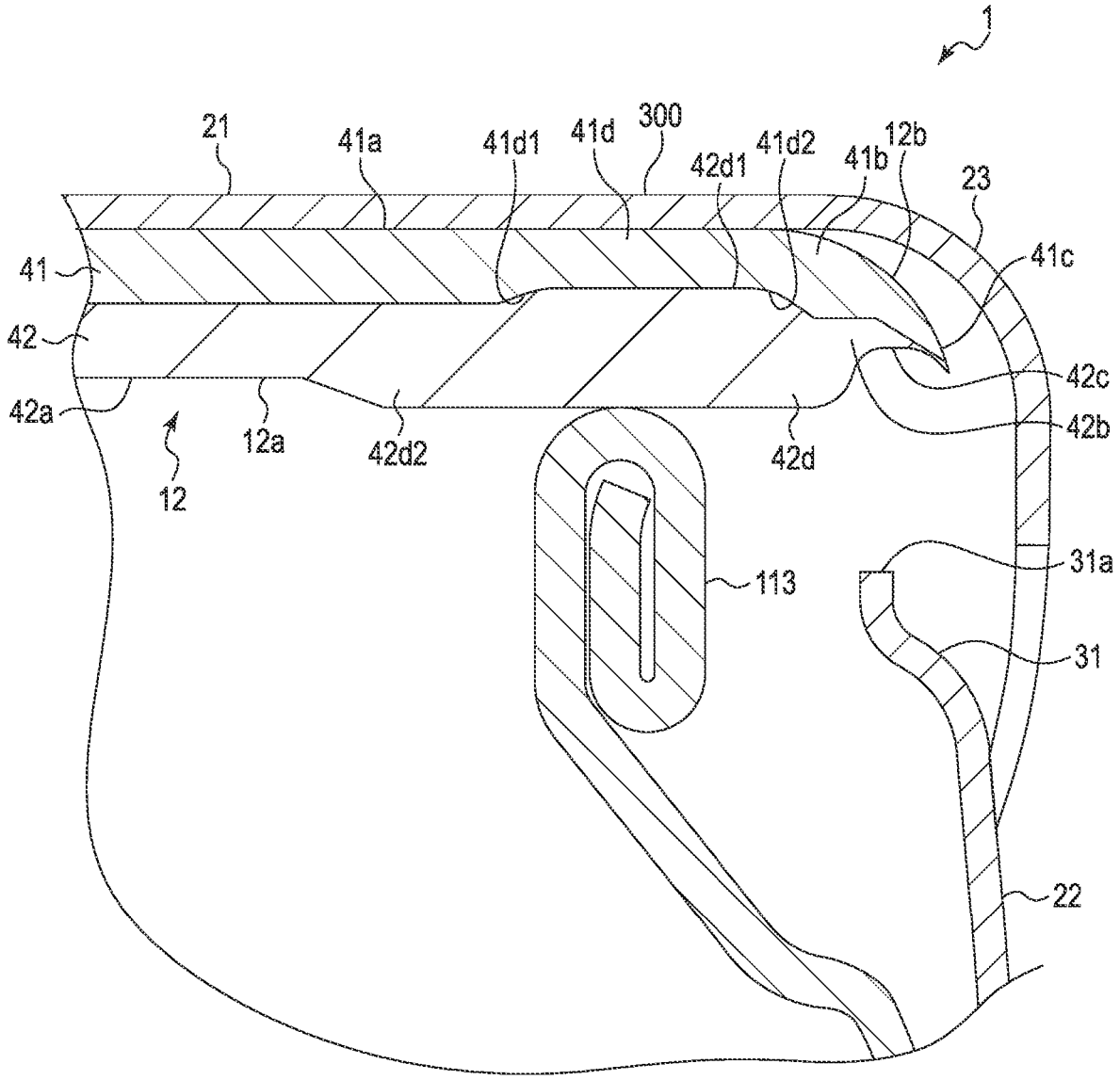
FIG. 8 cross-sectional view showing a configuration of a main part of a cap according to a second modification of the present invention.

Note that the present invention is not limited to the above embodiment. For example, in the example described above, the first curved surface portion 41*b* is configured in a manner that the portion adjacent to the first flat plate portion 41*a* has the same thickness as the first flat plate portion 41*a*; however, the present invention is not limited thereto. For example, as in a first modification shown in FIG. 7, the first flat plate portion. 41*a* may be thicker than a portion of the first curved surface portion 41*b* adjacent to the first flat plate portion 41*a*. Furthermore, for example, as in a second modification Shown in FIG. 8, the first flat plate portion 41*a* may be thinner than a portion of the first curved surface portion 41*b* adjacent to the first flat plate portion 41*a*.

Figure 9:
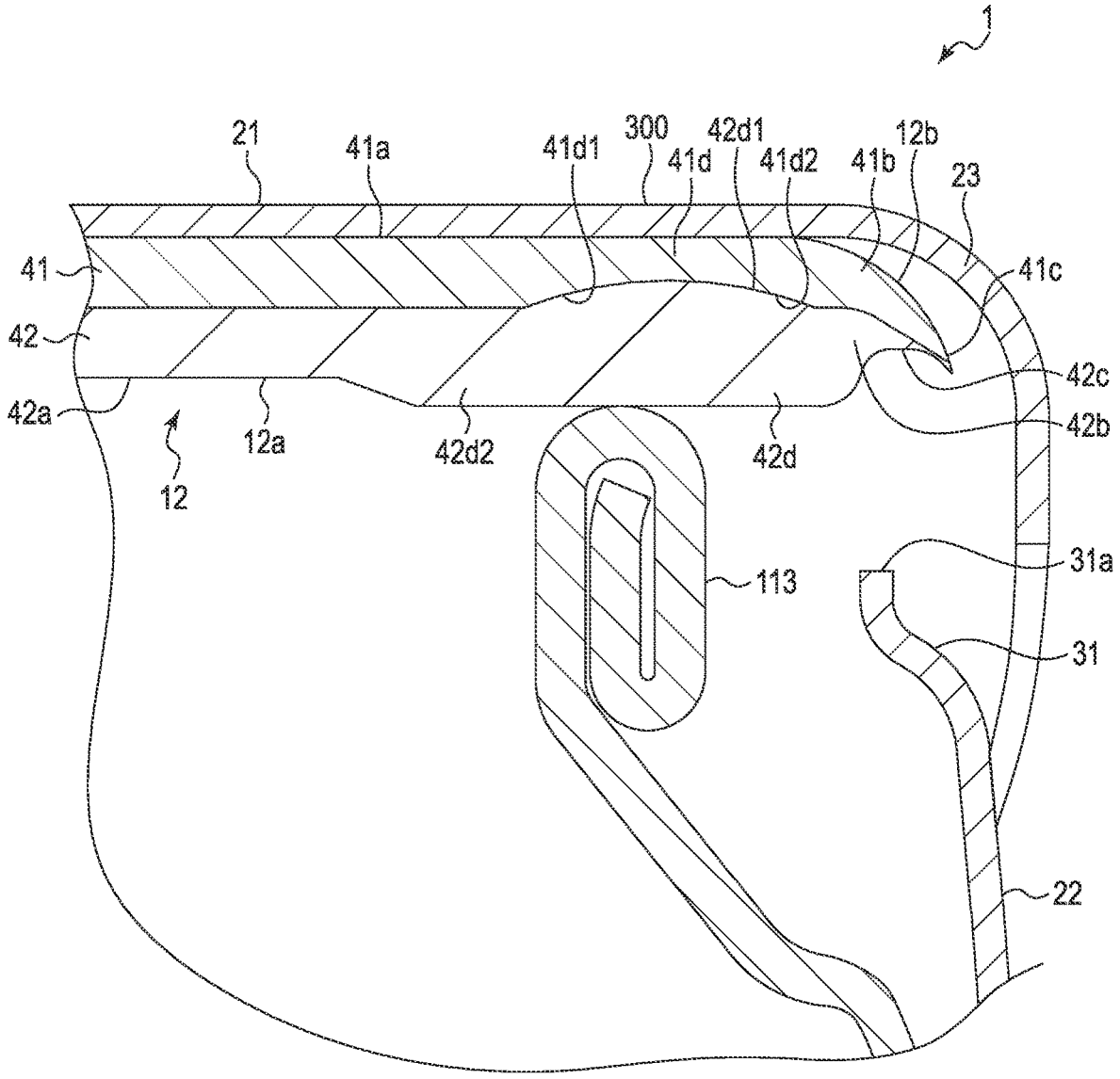
FIG. 9 is a cross-sectional view showing a configuration of a main part of a cap according to a third modification of the present invention.

In addition, in the example described above, the configuration in which the main surface of the thin portion 41*d* on the opening side of the skirt portion 22 is an annular recess parallel to the main surface of the first flat plate portion 41*a* on the opening side of the skirt portion 22 has been described, but the configuration is not limited thereto. For example, as in a third modification shown in FIG. 9, the thin portion 41*d* may be an annular recess in which the main surface on the opening side of the skirt portion 22 is curved.

Figure 10:
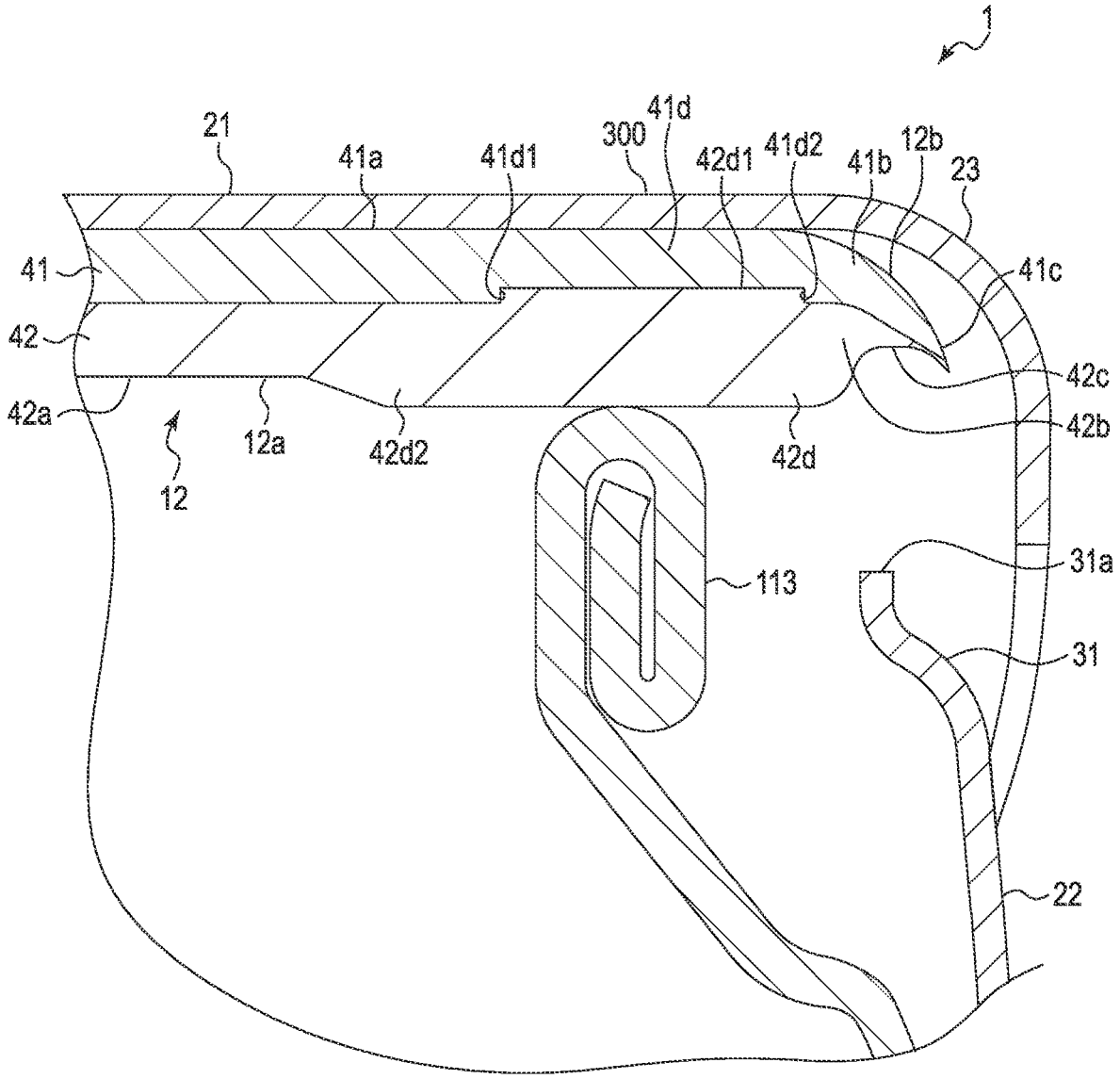
FIG. 10 is a cross-sectional view showing a configuration of a main part of a cap according to a fourth modification of the present invention.

Furthermore, in the example described above, the thin portion 41*d* has the inclined surface 41*d*1 at one end in the radial direction, and the main surface of the thin portion 41*d* and the main surface of the first flat plate portion 41*a* are made continuous by the inclined surface 41*d*1. However, the inclination angle of the inclined surface 41*d*1 may be an angle orthogonal to the main surface of the thin portion 41*d* and the main surface of the first flat plate portion 41*a* as in a fourth modification shown in FIG. 10. The inclined surface 41*d*1 may be formed in a curved surface shape.

Furthermore, in the example described above, the configuration in which the thin portion 41*d* is disposed at the position facing the base point 300 of the deformation of the top plate portion 21 at the time of drawing the corner portion 23 of the cap body 11 has been described, but the configuration is not necessarily limited thereto.

That is, by providing the thin portion 41*d* in the sliding layer 41, the bending strength of the sliding layer 41 itself decreases. Therefore, even when the thin portion 41*d* is not disposed at a position facing the base point 300 of the deformation of the top plate portion 21 at the time of drawing the corner portion 23 of the cap body 11, it is possible to reduce the load that deforms the sliding layer 41 when drawing the corner portion 23 compared to a sealing member including a sliding layer that does not have the thin portion 41*d*. However, in view of the above-described effect, as described above, it is most preferable that the thin portion 41*d* be disposed at a position facing the base point 300 of the deformation of the top plate portion 21 at the time of drawing the corner portion 23 of the cap body 11.

In addition, in the example described above, the configuration in which the thin portion 41*d* is provided on the first flat plate portion 41*a* in a manner adjacent to the first curved surface portion 41*b* has been described, but the configuration is not limited thereto. For example, the thin portion 41*d* may be disposed slightly on the axial line side from the end portion on the radially outer side of the first flat plate portion 41*a*. In this case, the portion adjacent to the radially inner and outer sides of the thin portion 41*d* is the portion of the first flat plate portion 41*a* excluding the thin portion 41*d*.

It should be noted that the present invention is not limited to the above-described embodiment, and various modifications can be made without departing from the spirit of the invention in the implementation stage. In addition, the embodiments may be appropriately combined and implemented, in which case a combined effect is obtained. Furthermore, various inventions are included in the above embodiments, and various inventions can be extracted by a combination selected from a plurality of disclosed constituent elements. For example, even if some constituent elements are deleted from all the constituent elements shown in the embodiments, if the problem can be solved and the effect can be obtained, the configuration from which the constituent elements are deleted can be extracted as the invention.

The invention claimed is:

1. A cap comprising:

a cap body including a disk-shaped top plate portion, a cylindrical skirt portion provided at a peripheral edge portion of the top plate portion, and a corner portion being continuous with the top plate portion and with the skirt portion; and a disk-shaped sealing member including a sliding layer and a sealing layer, the sliding layer disposed on the top plate portion side and having a thin portion thinner than at least a center side of the sliding layer, the thin portion being provided on an outer peripheral edge side, and the sealing layer provided on a main surface opposite to the top plate portion side of the sliding layer and sealing a mouth portion of a can container, wherein an outer diameter of the sliding layer is smaller than an inner diameter of the skirt portion, wherein the thin portion of the sliding layer is an annular recess formed on the outer peripheral edge side of the main surface in which the sealing layer is provided, and wherein the thin portion is provided at a position facing a base point of deformation of the top plate portion when the corner portion of the cap body is being drawn.

2. The cap according to claim 1, wherein the thin portion is provided at a position adjacent to a portion of the sealing layer facing the mouth portion in the axial direction when the cap is being attached to the can container.

3. The cap according to claim 1, wherein a portion of the sealing member facing the mouth portion is configured to be thicker than other portions of the sealing member.

4. The cap according to claim 1, wherein a portion of the sliding layer on a radially outer side of the thin portion is configured to be thicker than the thin portion.

5. The cap according to claim 1, further comprising a plurality of locking portions provided on the skirt portion and configured to restrict movement of the sealing member in a direction away from the top plate portion.

* * * * *